United States Patent [19]

Suttles

[11] Patent Number: 4,662,114

[45] Date of Patent: May 5, 1987

[54] SHEET METAL DOOR FOR CABINETS AND THE LIKE

[75] Inventor: J. Marshall Suttles, Elberton, Ga.

[73] Assignee: Royston Corporation, Royston, Ga.

[21] Appl. No.: 814,674

[22] Filed: Dec. 30, 1985

[51] Int. Cl.[4] ..... E06B 3/00

[52] U.S. Cl. ..... 49/501; 49/460

[58] Field of Search ..... 49/460, 501; 312/320

[56] References Cited

U.S. PATENT DOCUMENTS

| | | | |
|---|---|---|---|
| 2,341,093 | 2/1944 | Haberstump | 312/320 X |
| 2,766,857 | 10/1956 | Miller | 49/460 |
| 3,190,713 | 6/1965 | Vander Sande et al. | 312/320 |
| 3,294,463 | 12/1966 | Kafferlin et al. | 312/320 X |
| 3,648,411 | 3/1972 | Saunders et al. | 312/320 X |
| 4,478,465 | 10/1984 | Sulcek | 312/320 X |

OTHER PUBLICATIONS

Photograph showing doors of Toshiba storage cabinet.

*Primary Examiner*—Philip C. Kannan
*Attorney, Agent, or Firm*—Howson and Howson

[57] ABSTRACT

A cabinet door comprises a sheet metal door panel having a flange extending rearwardly along one vertical edge, and a sheet metal handle of uniform horizontal cross-section extending vertically along the flange and secured thereto. The handle itself forms part of the closure. Because of symmetry, the handle and the door panel can be used in both right and left handed configurations. The handle can be grasped at any location along its height, and is advantageous for cabinets at hard-to-reach locations.

4 Claims, 9 Drawing Figures

SHEET METAL DOOR FOR CABINETS AND THE LIKE

BRIEF SUMMARY OF THE INVENTION

This invention relates to sheet metal doors for cabinets and the like and particularly to a simplified and advantageous construction for such doors. Although the invention is generally applicable to sheet metal cabinets, it has particular utility in hinged sheet metal doors for under-the-counter storage cabinets used in convenience stores and the like. In such cabinets, door handles either project outwardly from the door, or are flush with the face of the door. Outwardly projecting door handles are undesirable because they project into aisles, catch clothing, and otherwise interfere with movement past the cabinets. Flush door handles, on the other hand, are more difficult to make because they require an opening in the face of the door. If the opening for the door handle is at the midpoint of the height of the door, some persons may have difficulty in reaching it. On the other hand, if the opening is other than at the midpoint of the height of the door, then manufacturing problems arise, because left and right-hand doors are then different from each other.

In the cabinet door construction in accordance with the invention, the door handle extends vertically along one vertical edge of a door panel from top to bottom, and constitutes part of the face of the door. More specifically, the door comprises a sheet metal door panel having a planar front face with horizontal top and bottom edges and at least one straight vertical edge extending from the top edge to the bottom edge of the door panel. The door panel also has a flange extending rearwardly from said vertical edge. A handle is secured to the flange, and extends vertically substantially from the level of the horizontal top edge of the panel to the level of the horizontal bottom edge thereof. This handle is of uniform horizontal cross-section throughout its vertical length, and is a unitary sheet metal element comprising four sections. A first section abuts the flange of the door panel, and has a front edge adjacent to said straight vertical edge of the door panel. The second section is a planar vertical section having a front edge and a rear edge. The front edge is located substantially in the plane of the face of the door panel, and said second section extends perpendicularly rearwardly from said plane and is spaced laterally from the door panel. A third vertical planar section is located substantially in the plane of the door panel, and extends from the front edge of the second section toward said vertical edge of the door panel. The third section terminates in a termination edge spaced from the front edge of the first section to provide an opening. A fourth section connects the first section to the rear edge of the second section, and is spaced from the termination edge of the second section so that a space is provided between said third and fourth sections which a user's fingers can enter through the opening between the termination edge and the front edge of the first section.

Preferably, the fourth section of the handle extends from the rear edge of the second section to the front edge of the first section. Also, in the preferred embodiment, the flange of the door panel and the first section of the handle which abut the flange, both extend perpendicular to the front face of the door panel, and the fourth section of the door handle comprises an oblique element extending both rearwardly from said front edge of the first section and outwardly with respect to said first section. This oblique element, and the door panel itself, hide fasteners which extend through the flange of the door panel and the section of the handle abutting the flange.

To provide more room for the user's fingers to enter the space between the third and fourth sections of the handle, the fourth section may also include an element parallel to the front face of the door panel and extending from the rear edge of the second section of the handle to the oblique element of the fourth section. The element of the fourth section of the handle which is parallel to the face of the door is preferably located to the rear of the plane of the face of the door by a distance not greater than the distance between the face of the door and the rear edge of the flange of the door panel.

Preferably, the termination edge of the third section of the handle is a rearwardly rolled edge.

The cabinet door construction in accordance with the invention has the following among its objects and advantages.

First, because the door handle is uniform in cross-section, and extends substantially from the top edge to the bottom edge of the door, it can be grasped at any location along the height of the door.

Secondly, the handle, and the entire door assembly, including both the door panel and the handle, are symmetrical. Thus, the handle can be used both on right and left handed doors. Furthermore, the door panel itself can be symmetrical about a horizontal midline, and thus the entire door assembly, including the door panel and the handle, can be used either has a right handed door or as a left handed door. The doors and handles can be used in a double-door arrangement, in which a single opening is closed by two doors hinged at the vertical edges of the opening, and having handles meeting each other at the middle of the opening.

A third advantage of the invention is that the handle and door can be fastened together in a simple manner by means of rivets or other fasteners extending through the flange on the edge of the door panel and the abutting first section of the handle. The door panel itself can be of extremely simple construction.

Fourth, the handle itself is simple, and easy to make on sheet metal-forming machinery in any desired length. The method of forming the handle does not differ for different door handle lengths.

Fifth, the door handle itself, being attached at the edge of a door panel, forms part of the door. The result is that the door is light in weight, yet at least as strong as a door in which a handle is added to a full-width door panel.

A sixth advantage of the invention is that the door panels can be used not only with the specific sheet metal handle of the invention, but with alternative handles. Likewise it is possible to use the specific handles of the invention with alternative doors, for example doors of different widths, or of different colors. Consequently, it is practical to maintain large inventories of door panels and of door handles.

A seventh advantage of the invention is that the fasteners which attach the handles to the door panels are hidden from the view of the persons located in front of the doors, by virtue of the oblique elements of the fourth sections of the door handles. The hiding of the fasteners results in a door having a unique, smooth, and pleasing appearance.

Various other objects and advantages of the invention will be apparent from the following detailed description, when read in conjunction with the drawings.

DETAILED DESCRIPTION

As shown in FIGS. 2–6, the door in accordance with the invention comprises a sheet metal door panel 10 having a planar front face 12. Face 12 is substantially rectangular, having horizontal top and bottom edges, and straight left and right vertical edges. A sheet metal handle 14 is secured at the left-hand vertical edge of the door panel, and extends from the top edge of the door panel to the bottom edge.

Figure 1:
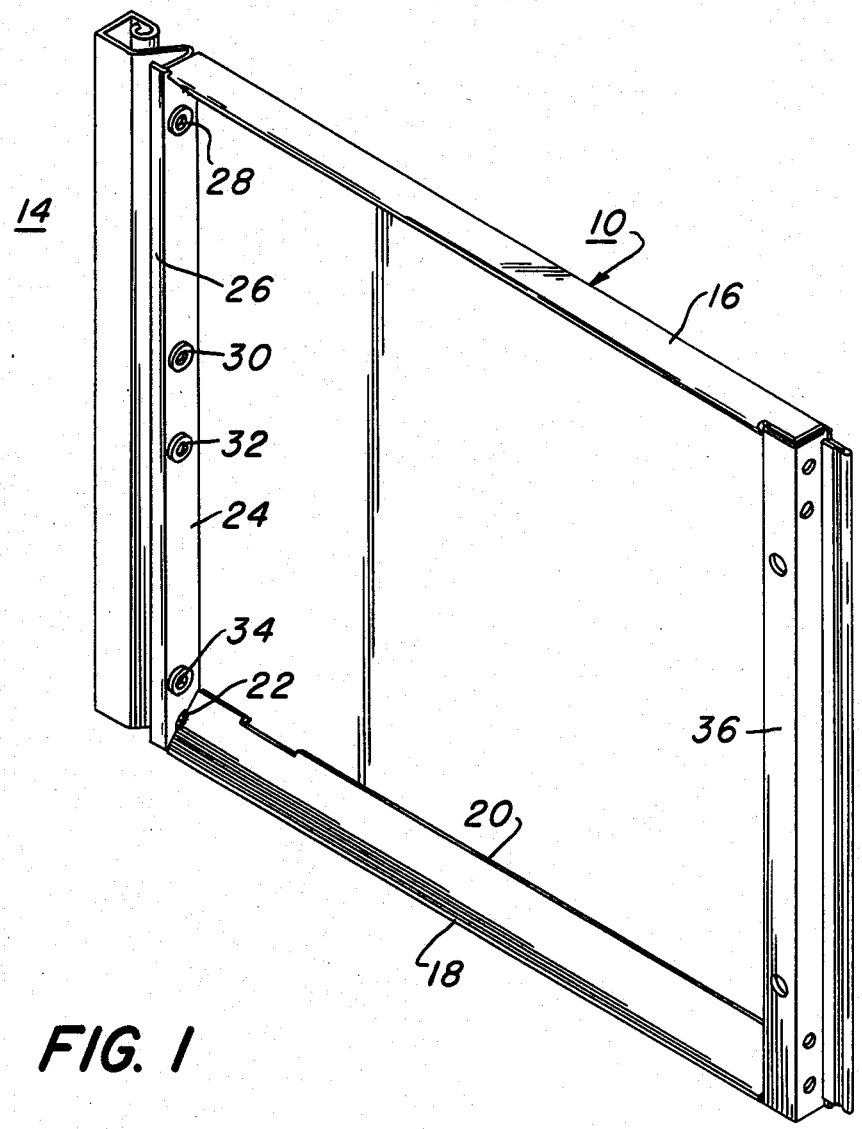
FIG. 1 is a perspective view showing the inside face of a door in accordance with the invention.
Figure 2:
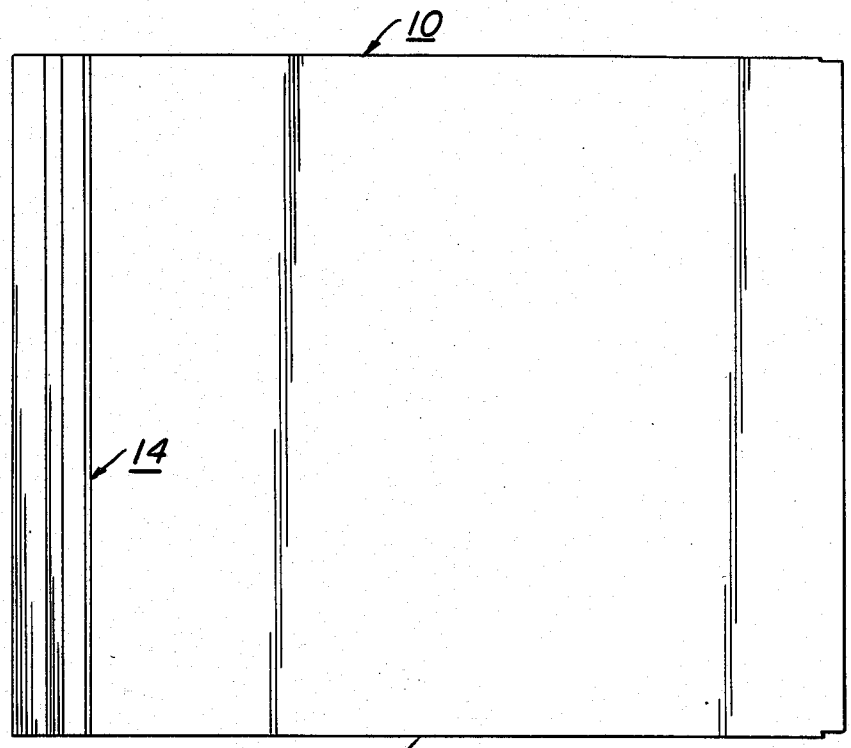
FIG. 2 is a front elevation of the door.
Figure 3:
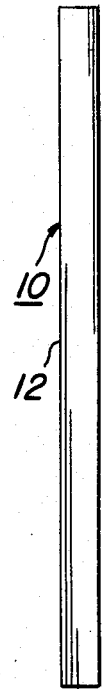
FIG. 3 is a left side elevation thereof.
Figure 5:
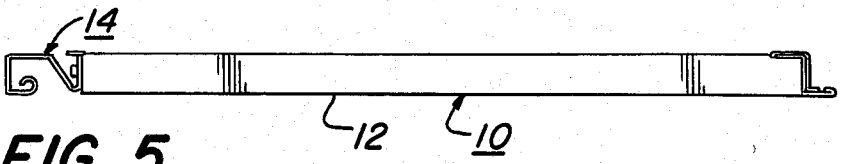
FIG. 5 is a top plan view thereof.
Figure 6:
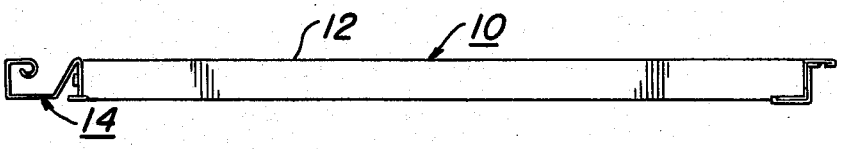
FIG. 6 is a bottom plan view thereof.
Figure 4:
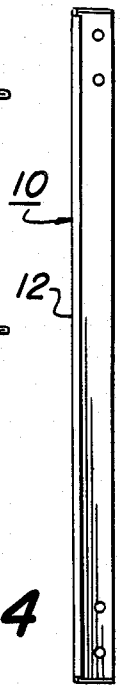
FIG. 4 is a right side elevation thereof.
Figure 9:
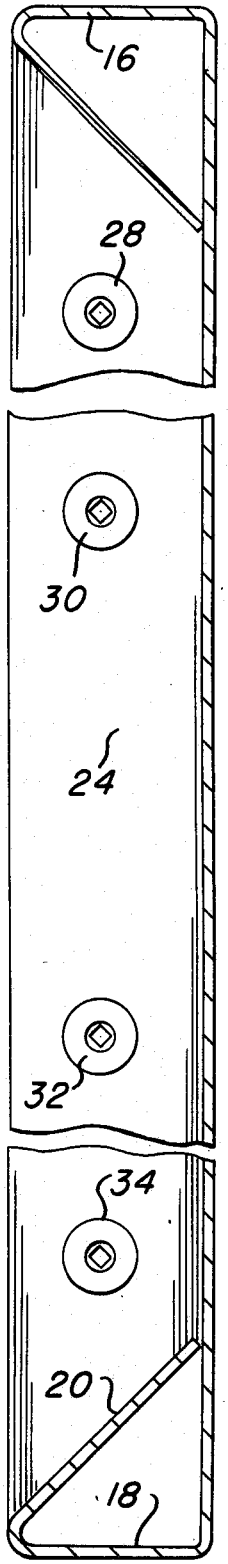
FIG. 9 is a vertical section through the door.

As shown in FIG. 1, which is a rear view of the door, the top edge of the door panel has a rearwardly horizontal flange 16, and the bottom edge of the door panel has a similar rearwardly extending horizontal flange 18. An oblique section 20 extends upwardly and inwardly from flange 18 to the rear face of the door, and is welded at 22 to flange 24, which extends rearwardly from one of the vertical edges of the door panel, preferably perpendicular to the face of the door panel. Upper flange 16 has an oblique section similar to oblique section 20 of lower flange 18, as best seen in FIG. 9.

Vertical flange 24 has a perpendicularly outwardly extending reinforcement 26 at its rearmost edge. Handle 14 is secured to flange 24 by rivets 28, 30, 32 and 34.

Figure 8:
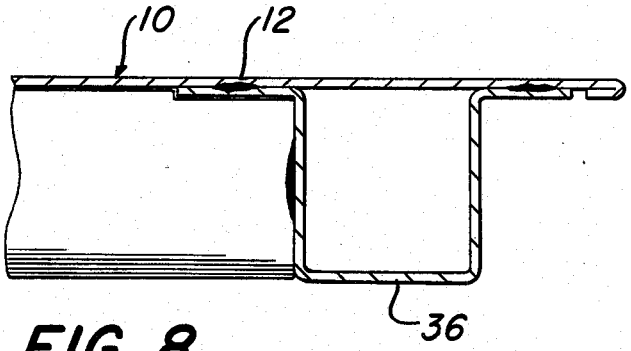
FIG. 8 is a fragmentary horizontal section through the door panel at the location of the hinged edge thereof.

Near the edge of the door opposite the handle, a channel 36 is provided for mounting hinges. The relationship between channel 36 and door panel 12 is best shown in FIG. 8.

Figure 7:
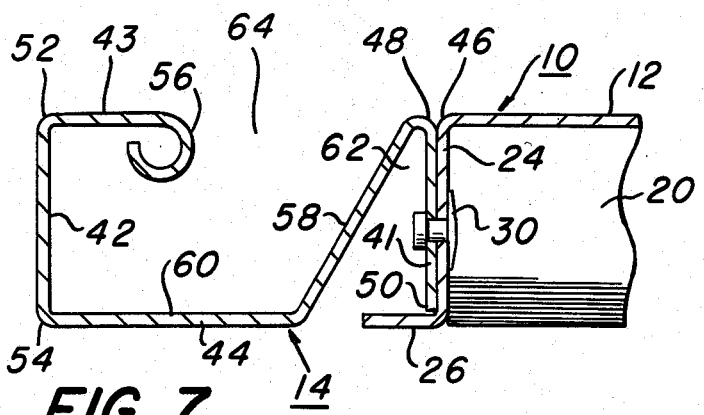
FIG. 7 is a fragmentary horizontal section through the handle, showing the connection of the handle to the door panel.

Referring to FIG. 7, handle 14 comprises four vertical planar sections, including a first section 41, a second section 42, a third section 43, and a fourth section 44.

First section 41 is in abutment with rearwardly extending flange 24 of the door panel. Section 41 is riveted to flange 24 as shown, and its front edge 48 is located adjacent vertical edge 46 of face 12 of the door panel. Its rearmost edge 50 is located adjacent reinforcement 26.

The second section 42 of the handle is laterally spaced from edge 46 of the door panel, and extends perpendicularly rearwardly from the plane of the face of the door panel from a front edge 52 to a rear edge 54. Front edge 52 is preferably located in the plane of face 12 of the door panel, and rear edge 54 is preferably spaced from edge 52 by the same distance by which reinforcement 26 is spaced from edge 46 of the door panel.

Third section 43 of the handle extends from front edge 52 of second section 42 toward vertical edge 46 of the door panel. Section 43 is preferably located substantially in the plane of the door panel, and terminates at an edge 56, which is spaced from edge 48 of section 41 to provide an opening 64. Termination edge 56 is preferably an inwardly rolled edge so that the handle can be grasped without causing injury.

Fourth section 44 of the handle connects rear edge 54 of second section 42 to first section 41. Preferably, section 44 extends from rear edge 54 of section 42 to front edge 48 of first section 41.

In the preferred form of the handle, fourth section 44 comprises an oblique element 58 extending both rearwardly and outwardly from edge 48 of section 41, and an element 60, which extends parallel to the plane of the door panel, and which is spaced rearwardly from third section 43.

Oblique section 58 hides portions of rivets 28–34 from the view of persons located in front of the door panel, while providing a space 62 whidh accommodates these portions of the rivets. The opposite ends of the rivets are hidden behind the door panel. At the same time, element 60 of section 44, being parallel to the face of the door panel, allows sufficient space between sections 43 and 44 to accommodate a user's fingers, which can be inserted through opening 64 between termination edge 56 of section 43, and front edge 48 of section 41. Element 60 of fourth section 44, which is the rearmost part of the handle, is preferably located a sufficient distance behind third section 43 to accommodate any sizes of fingers. However element 60 should not extend any farther rearwardly than the rearmost extent of flange 24. Stated another way, flange 24 should extend at least as far rearwardly as element 48.

The door panel and handle can be easily secured together by rivets, which can be inserted through aligned holes in flange 24 and handle section 41 from the rear of the door panel, as shown in FIG. 1.

As will be apparent from the foregoing, opening 64 of the handle is flush with the face 12 of the door panel. Both the door panel and the handle are extremely simple in construction, and can be readily secured together. The door handle can be grasped at any location along its height, and is thus ideal for cabinets at hard-to-reach locations. The symmetry of the doors and handles makes it possible to use the same elements for both right and left handed doors, with the result that there is a significant simplification of the manufacturing process.

I claim:

1. A sheet metal door for a cabinet or the like comprising:

a sheet metal door panel having a planar front face with horizontal top and bottom edges and at least one straight vertical edge extending from said top edge to said bottom edge, and a flange extending rearwardly from said vertical edge; and a handle secured to said flange, said handle extending vertically substantially from the level of the horizontal top edge of the panel to the level of the horizontal bottom edge thereof, and having a uniform horizontal cross-section throughout its vertical length;

in which the handle is a unitary sheet metal element comprising a first vertical planar section abutting said flange of the door panel and having a front edge adjacent to said straight vertical edge of the door panel, a second vertical planar section having a front edge and a rear edge, said front edge being located substantially in the plane of the face of the door panel, said second section extending perpendicularly rearwardly from the plane of the face of the door panel and being spaced laterally from said door panel, a third vertical planar section located substantially in the plane of the door panel, said third section extending from said front edge of the second section toward said vertical edge of the door panel and terminating in a termination edge spaced from the front edge of said first section to provide an opening, and a fourth section connecting the first section to the rear edge of the second section and being spaced from said termination edge whereby a space is provided between said third and fourth sections which a user's fingers can enter through said opening;

in which the fourth section of the handle extends from the rear edge of the second section to the front edge of the first section,; and in which the fourth section of the handle comprises an oblique element extending both rearwardly from said front edge of the first section and outwardly with respect to said first section;

and including a plurality of fasteners extending through said flange and said first section of the handle abutting the flange, each of said fasteners having a first end located behind said door panel and a second end located behind said oblique element of the fourth section of the handle, whereby the fasteners are hidden from the view of persons located in front of the door panel.

2. A sheet metal door according to claim 1 in which the flange extends at least as far rearwardly from the plane of the face of the panel as the rearmost part of the handle.

3. A sheet metal door for a cabinet or the like comprising:

a sheet metal door panel having a planar front face with horizontal top and bottom edges and at least one straight vertical edge extending from said top edge to said bottom edge, and a flange extending rearwardly from said vertical edge; and a handle secured to said flange, said handle extending vertically substantially from the level of the horizontal top edge of the panel to the level of the horizontal bottom edge thereof, and having a uniform horizontal cross-section throughout its vertical length;

in which the handle is a unitary sheet metal element comprising a first vertical planar section abutting said flange of the door panel and having a front edge adjacent to said straight vertical edge of the door panel, a second vertical planar section having a front edge and a rear edge, said front edge being located substantially in the plane of the face of the door panel, said second section extending perpendicularly rearwardly from the plane of the face of the door panel and being spaced laterally from said door panel, a third vertical planar section located substantially in the plane of the door panel, said third section extending from said front edge of the second section toward said vertical edge of the door panel and terminating in a termination edge spaced from the front edge of said first section to provide an opening, and a fourth section connecting the first section to the rear edge of the second section and being spaced from said termination edge whereby a space is provided between said third and fourth sections which a user's fingers can enter through said opening; and in which the fourth section of the handle extends from the rear edge of the second section to the front edge of the first section, and comprises an oblique elemnt extending both rearwardly from said front edge of the first section and outwardly with respect to said first section and an element parallel to the planar front face of the door panel extending from the rear edge of said second section to said oblique element;

and including a plurality of fasteners extending through said flange and said first section of the handle abutting the flange, each of said fasteners having a first end located behind said door panel and a second end located behind said oblique element of the fourth section of the handle, whereby the fasteners are hidden from the view of persons located in front of the door panel.

4. A sheet metal door according to claim 3 in which said element parallel to the planar front face of the door panel is the rearmost part of the handle, and said flange extends at least as far rearwardly from the plane of the face of the panel as does said parallel element.

* * * * *

UNITED STATES PATENT AND TRADEMARK OFFICE

CERTIFICATE OF CORRECTION

PATENT NO. : 4,662,114

DATED : May 5, 1987

INVENTOR(S) : J. Marshall Suttles

It is certified that error appears in the above-identified patent and that said Letters Patent are hereby corrected as shown below:

Column 4, line 32, "48" should be --44--

Signed and Sealed this

First Day of September, 1987

*Attest:*

*Attesting Officer*

DONALD J. QUIGG

*Commissioner of Patents and Trademarks*